US007445280B2

(12) United States Patent
Stoline-Litwin

(10) Patent No.: US 7,445,280 B2
(45) Date of Patent: Nov. 4, 2008

(54) PRIVACY PARTITION ASSEMBLY FOR NURSING MOTHER

(76) Inventor: Anne Marie Stoline-Litwin, 12520 Jerusalem Rd., Kingsville, MD (US) 21087

( * ) Notice: Subject to any disclaimer, the term of this patent is extended or adjusted under 35 U.S.C. 154(b) by 1296 days.

(21) Appl. No.: 10/124,229

(22) Filed: Apr. 18, 2002

(65) Prior Publication Data

US 2003/0197405 A1 Oct. 23, 2003

(51) Int. Cl.
*A47C 7/62* (2006.01)

(52) U.S. Cl. ..... 297/184.15; 297/487; 160/335

(58) Field of Classification Search ..... 297/184.1, 297/184.11, 184.14, 184.15, 184.16, 188.16, 297/188.17, 468.2, 188.01, 188.09, 487; 128/849; 160/335; 114/363, 361; 4/599; 5/163

See application file for complete search history.

(56) References Cited

U.S. PATENT DOCUMENTS 626,753 A * 6/1899 Ernest ..... 312/6
1,234,067 A * 7/1917 Negrete ..... 5/141
1,403,543 A 1/1922 Daniel
1,432,383 A * 10/1922 Comings ..... 5/513
1,683,944 A 9/1928 Balch
1,750,284 A * 3/1930 Rusatz ..... 160/88
2,005,196 A * 6/1935 Mears ..... 4/608
2,014,205 A * 9/1935 Linden ..... 5/512
3,339,566 A * 9/1967 Bowden ..... 297/184.11
3,418,665 A * 12/1968 Long ..... 4/610
3,839,816 A * 10/1974 Fischereder ..... 446/82
4,113,222 A * 9/1978 Frinzel ..... 248/412
4,158,896 A * 6/1979 Farkas ..... 4/558
4,199,829 A 4/1980 Watanabe et al.
4,361,914 A * 12/1982 Oliver ..... 4/605
4,457,553 A * 7/1984 Larkin ..... 296/160
4,511,157 A * 4/1985 Wilt, Jr. ..... 280/304.1
4,721,490 A * 1/1988 Draugelis ..... 446/82
4,989,268 A * 2/1991 Stolhand ..... 2/104
5,106,153 A * 4/1992 Durling ..... 297/232
5,294,005 A * 3/1994 Hedges ..... 211/85.7
5,331,917 A * 7/1994 Magers ..... 114/361
5,379,466 A * 1/1995 Davies ..... 4/449
5,441,067 A 8/1995 James et al.
5,652,960 A 8/1997 Kaknevicius
5,666,765 A * 9/1997 Sarner et al. ..... 52/36.1
5,920,927 A * 7/1999 Thomas ..... 4/599
5,921,258 A 7/1999 Francois
6,112,748 A * 9/2000 Esdale et al. ..... 128/898
6,302,053 B1 * 10/2001 Tomczak et al. ..... 114/363

FOREIGN PATENT DOCUMENTS

GB 164244 6/1920

* cited by examiner

*Primary Examiner*—David R Dunn
(74) *Attorney, Agent, or Firm*—Diederiks & Whitelaw, PLC

(57) ABSTRACT

A privacy screen assembly, designed for use by a nursing mother, includes at least one cross member which carries a screen. The cross member is adapted to be connected to a wheeled transport device or the like for the nursing mother. Preferably, the cross member is movable between a stowed position, wherein the cross member placed in an unobtrusive location, and an in-use position, wherein the cross member extends across the torso of the nursing mother. The screen is slidably mounted on the cross member to provide the requisite privacy.

26 Claims, 6 Drawing Sheets

PRIVACY PARTITION ASSEMBLY FOR NURSING MOTHER

BACKGROUND OF THE INVENTION

1. Field of the Invention

The present invention relates to an assembly for protecting the privacy of a nursing mother and, more specifically, to an occupant supporting device including a privacy screen that selectively extends across the torso of a nursing 2. Discussion of the Prior Art Typically, the physical setting of many Neonatal Intensive Care Units is uninviting and uncomfortable for new mothers. Inadequate seating accommodations will also shorten a mother's visit to a baby's bedside. When mothers are denied adequate involvement in their baby's care during a critical biological window in the early post-delivery time period, strong and healthy emotional bonding with their newborns is compromised. Consequently, while modern medicine saves ever-greater numbers of premature and/or ill newborns, too many of these infants leave the hospital as emotional orphans.

One solution lies in making this environment more comfortable for new mothers so they can play a key role in their baby's care, including situations wherein the mother has experienced complications limiting her mobility. Introducing a chair, bed or other wheeled vehicle tailored to a woman's postpartum needs and designed for maximum mother-baby physical and emotional contact shortly after delivery would enhance that goal. Increased inclusion of parents in the care of a newborn baby functions to speed the baby's physical recovery and enhances the forging of loving bonds between parents and baby.

In addition, many nursing mothers face challenges when they have visitors both in the home and in the hospital. Attempts have been made to develop a privacy cover for nursing mothers. For example, U.S. Pat. No. 5,652,960 discloses a fabric cover that can be used by a nursing mother to drape over her baby to provide privacy for the mother and the baby during nursing periods. The nursing cover of the '960 patent includes a front portion for draping over a baby and the front of a nursing mother and a rear portion for draping over the shoulder and down the mother's back. Although the cover provides some privacy for a nursing mother, the cover of the '960 patent is rather tight to the body and requires a somewhat revealing, meshed section to avoid smothering. Therefore, the cover limits the mobility of both the mother and baby, which itself can be unsettling. In any event, the cover is not adapted to be readily attached to a chair or hospital bed to provide a comfortable, private environment in the hospital or home.

These conditions create the need for a privacy assembly that can be attached to and used in combination with an occupant supporting device, such as a wheeled chair or bed, in a nursery or hospital setting. A privacy screen assembly attached to a mobile chair or bed would allow a new mother to nurse her baby privately and facilitate the bonding of mother and baby during the critical in-hospital period.

SUMMARY OF THE INVENTION

The present invention is directed to a privacy screen assembly, preferably in connection with a wheeled transport device, that can be used by a nursing mother. More specifically, in accordance with a preferred embodiment of the invention, the privacy screen assembly is attached to an occupant supporting device in the form of a wheeled chair including a frame having a wheeled base, first and second side portions, and a back portion. The privacy screen assembly includes a cross member and a screen, with the cross member being supported by the wheeled chair for movement between a stowed position, wherein the cross member is lowered relative to the frame, and an in-use position, wherein the cross member extends across the torso of a nursing mother. The screen is connected to the cross member at a top edge and drapes down therefrom.

In accordance with the most preferred form of the invention, a pair of privacy screen assemblies are used in combination, with the cross member of each assembly extending partly across the torso of the mother and being interconnected to the other cross member. In any event, with this overall arrangement, the mobility and comfort of the mother is enhanced, while enabling the mother to provide early nurturing to the baby in a way which addresses potential privacy concerns. In accordance with other embodiments of the invention, the privacy screen assembly of the invention can be attached to other structures, such as a hospital bed, a conventional wheelchair, automobile structure, a table, and the like. In any case, when the cross member assumes the in-use position, the screen extends across the torso of the mother to provide privacy for nursing.

Additional objects, features and advantages of the invention will become more apparent from the following detailed description of preferred embodiments when taken in conjunction with the drawings wherein like reference numerals refer to corresponding parts in several views.

DETAILED DESCRIPTION OF THE PREFERRED EMBODIMENTS

Figure 1:
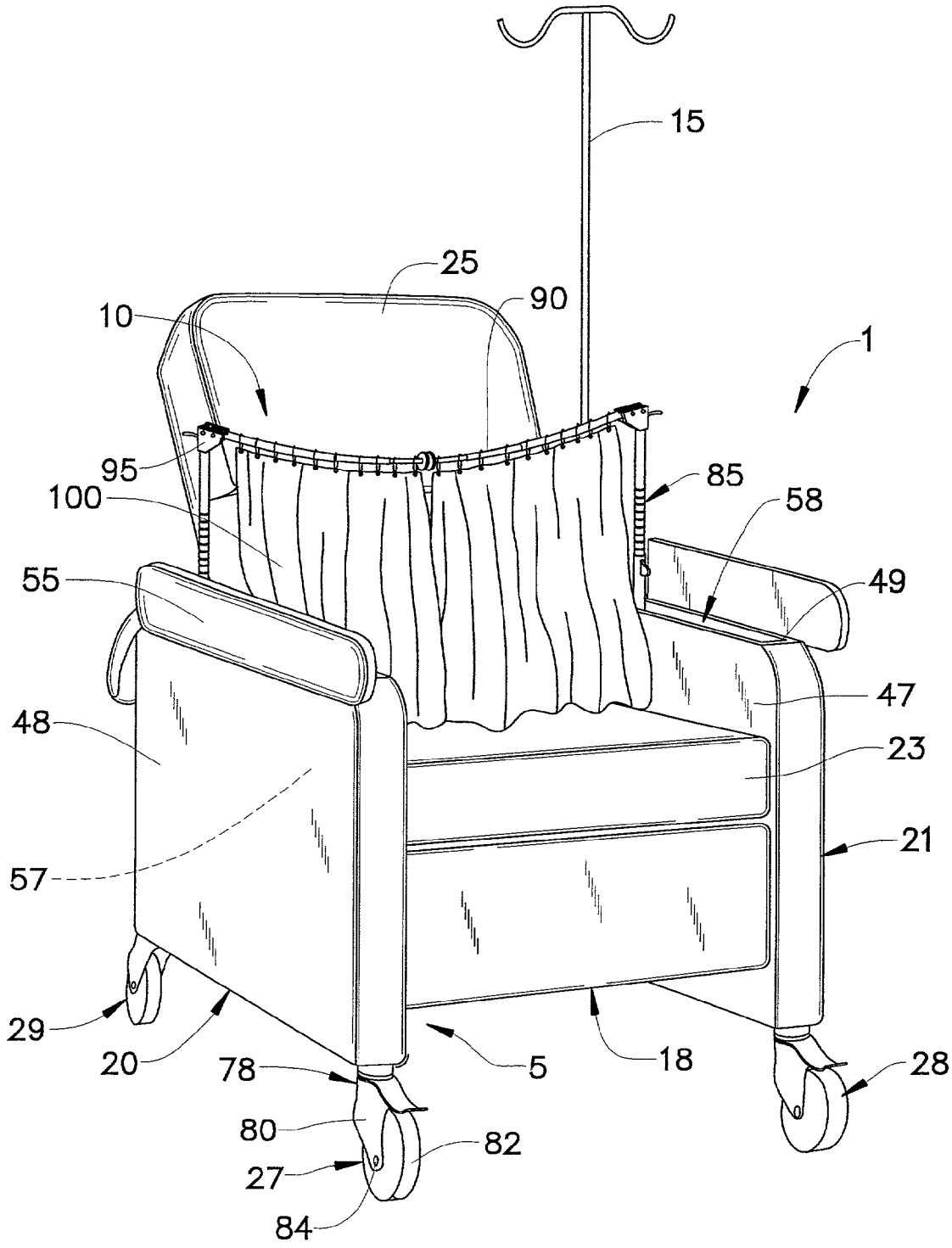
FIG. 1 is a perspective view of a wheeled transport device with a privacy partition assembly constructed in accordance with the present invention shown in an in-use position.

With initial reference to FIG. 1, a wheeled transport device is generally indicated at 1. As shown, wheeled transport device 1 includes a frame assembly 5, a privacy partition assembly 10, and an IV pole 15. The overall frame assembly 5 includes a base 18, two side portions 20 and 21, a cushioned seat 23, a selectively reclining back 25, two front wheel assemblies 27 and 28, and two back wheels, one of which is shown at 29. Bach of the first and second side portions 20 and 21 of frame 5 includes inner and outer panels 47 and 48. The top end 49 of each of the first and second side portions 20 and 21 includes a respective arm rest 55 which is pivotably attached to the corresponding outer panel 48, thereby allowing the arm rest 55 to pivot to a position in which it is substantially, vertically aligned with the outer panel 48 of the corresponding side portion 20, 21 in order to expose respective storage compartments 57 and 58.

In the embodiment shown, each of the wheel assemblies 27 and 29 includes a castor 78, a U-shaped bracket 80, and a wheel 82. As known in the art, each bracket 80 is adapted to rotate about a generally vertical axis, thereby allowing a respective castor 78 to swivel. In addition, each bracket 80 includes a shaft 84, which extends horizontally through bracket 80, thereby defining an axis about which wheel 82 rotates. If desired, wheel assemblies 27 and 29 can be locked in order to stabilize wheeled transport device 1 in a fixed position.

Except for the structure defining storage compartments 57 and 58, the general structure of wheeled transport device 1 as described above is known in the art and therefore the above details have essentially only been provided for the sake of completeness. Of particular concern to the present invention is the incorporation of privacy partition assembly 10 on wheeled transport device 1. In accordance with a preferred embodiment of the invention, wheeled transport device 1 is actually provided with a pair of privacy partition assemblies 10. As illustrated, the basic structure of each privacy partition assembly 10 includes an extension pole 85, a cross member 90, a corner bracket 95, and a screen 100.

Figure 4:
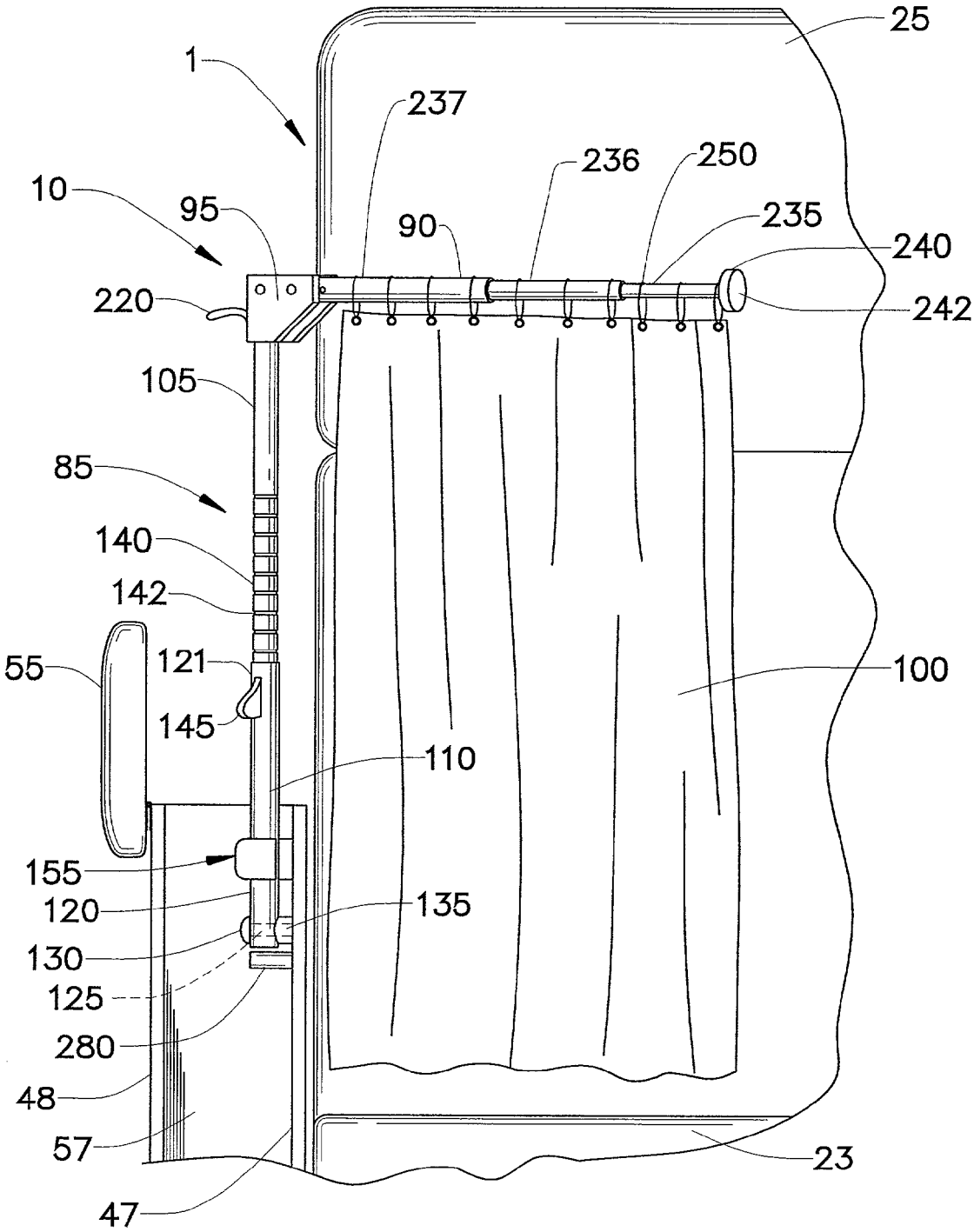
FIG. 4 is an expanded view of the privacy partition assembly in an open position.

As perhaps shown best in FIG. 4, each extension pole 85 includes a rod portion 105 and a tube portion 110. Tube portion 110 includes a first end portion 120 and a second end portion 121. First end portion 120 is provided with a cross bore 125 and is mounted for rotation to inner panel 47 through a mechanical fastener 130 and a spacer member 135. Rod portion 105 is slidably received within second end portion 121 of tube portion 110 such that rod portion 105 can be raised and lowered relative to a respective side 20, 21 and from within a respective storage compartment 57, 58. More specifically, rod portion 105 is preferably provided with a plurality of segments 140 which are spaced by annular recesses 142. A pawl member 145 extends through tube portion 110 and is adapted to be received in a selected one of the annular recesses 142 in order to establish the extent to which rod portion 105 projects from tube portion 110. The elongation of extension pole 85 is preferably performed through a ratcheting arrangement as pawl member 145 is biased into engagement with a respective annular recess 142, while the manual shifting of pawl member 145 is required to retract rod portion 105 within tube portion 110. As this type of ratchet arrangement is employed in various fields and is therefore known, no further details will be provided here.

Figure 6:
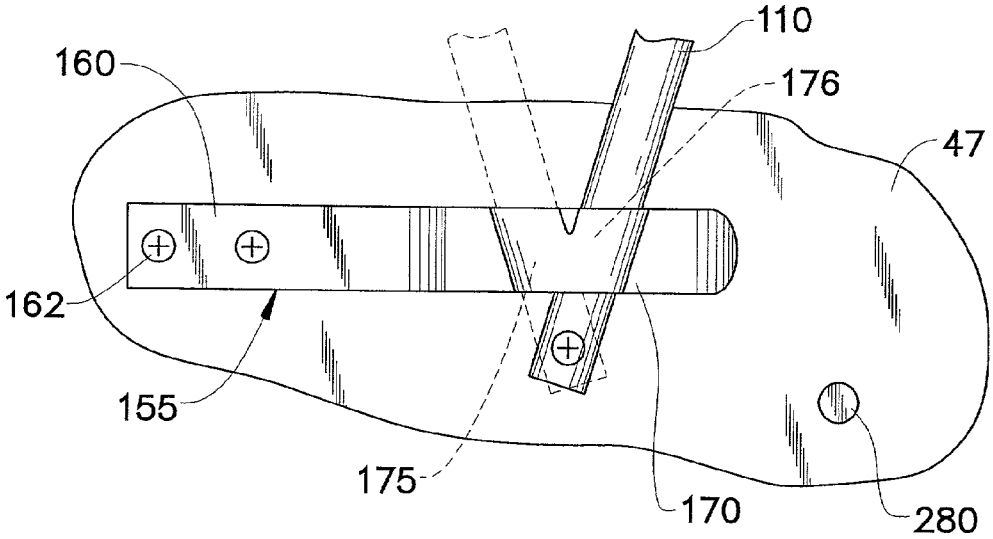
FIG. 6 is a side view of an adjustment portion of the privacy partition assembly.
Figure 7:
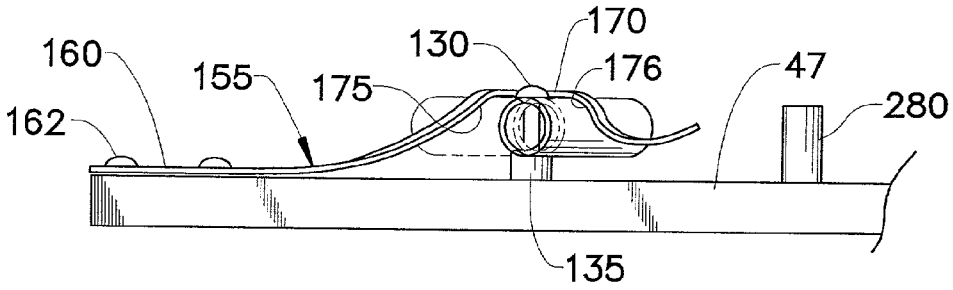
FIG. 7 is a bottom view of the adjustment portion of FIG. 6.

With this construction, extension pole 85 can be pivoted between storage and in-use positions. When privacy partition assembly 10 is in a storage or non-use position, rod portion 105 is retracted within tube portion 110. When privacy partition assembly 10 is in an extended or in-use position, rod portion 105 is exposed as shown in FIG. 4 and preferably extends generally parallel to raised armrest 55. In accordance with the invention, extension pole 85 can be retained in the in-use position and, preferably, in a selected one of various in-use positions. In the embodiment shown, a resilient retainer or catch member 155 is mounted to inner panel 47 within a respective storage compartment 57, 58. As perhaps best shown in FIGS. 6 and 7, catch member 155 constitutes a spring having a first end 160, which is secured to inner panel 47 such as through the use of a pair of screws 162, and a second end 170. Adjacent second end 170, catch member 155 is bent at spaced locations so as to define a pair of detents 175 and 176. With catch member 155 being arranged above the pivot location for tube portion 110, extension pole 85 can be selectively retained in multiple in-use positions defined by detents 175 and 176 for the reason discussed more fully below.

Figure 8:
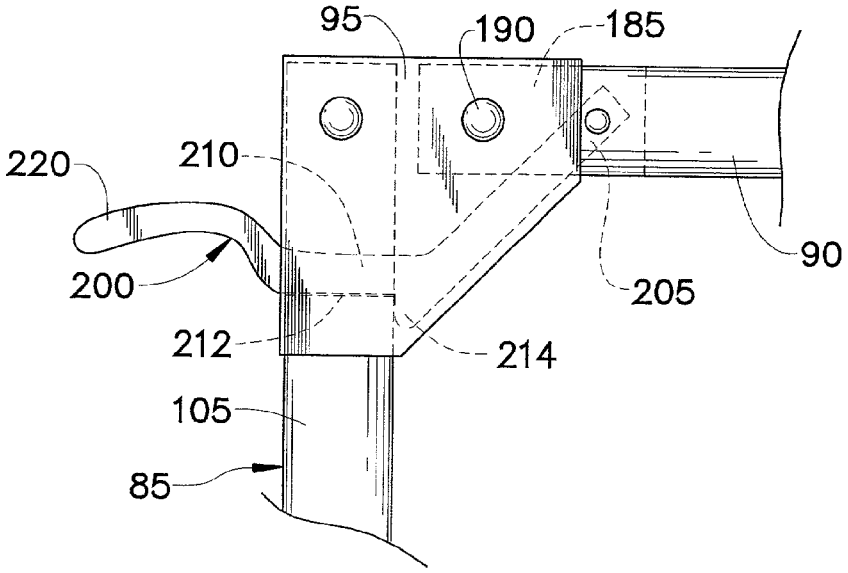
FIG. 8 is a side view of a cross member latch unit incorporated in the privacy partition assembly and shown in a latched condition.
Figure 9:
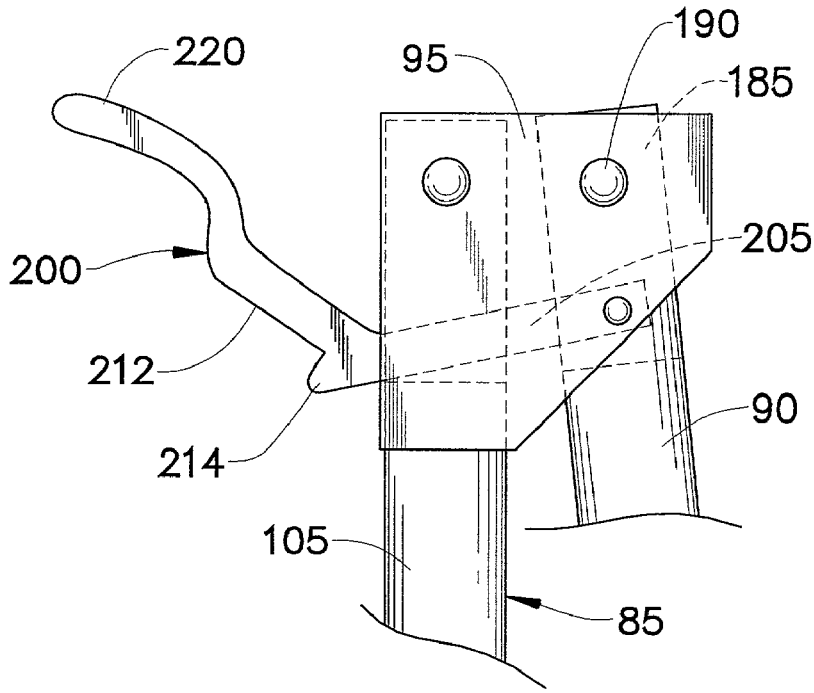
FIG. 9 is a side view of the latch unit of FIG. 8 in an unlatched state.

Referring to FIGS. 4, 8 and 9, at a bifurcated end spaced from tube portion 110, rod portion 105 is fixedly attached to corner bracket 95 such as through the use of one or more screws, a weld connection, or any similar fastening means. Also attached to corner bracket 95 is a first bifurcated end 185 of cross member 90. More specifically, first end 185 of cross member 90 is pivotably attached to corner bracket 95 at 190 (see FIGS. 4 and 8). Each corner bracket 95 is equipped with a quick release lever 200 for either holding cross member 90 in an extended or in-use position, or quickly allowing cross member 90 to pivot to a position substantially parallel with extension pole 85. More specifically, lever 200 has a first end portion 205 which is pivotally attached to cross member 90, an intermediate portion 210 including a ledge section 212 and a tab section 214, and a second end portion 220. When lever 200 is arranged in a holding position, as shown in FIGS. 1, 4 and 8, cross member 90 extends substantially perpendicular to extension pole 85. In this position, intermediate portion 210 extends along a portion of the bifurcated end 25 of rod portion 105 and tab section 214 abuts rod portion 105. On the other hand, a user can employ a finger to lift lever 200 at second end portion 220 in order to release cross member 90, thereby enabling cross member 90 to be folded to a position alongside rod portion 105 of extension pole 85 as best shown in FIG. 9.

Referring back to FIG. 4, cross member 90 preferably includes multiple telescoping segments 235, 236, and 237, as well as an end cap 240. When end cap 240 is pushed towards corner bracket 95, first segment 235 enters second segment 236 and second segment 236 enters third segment 237, thereby placing cross member 90 in a retracted position. Similarly, when end cap 240 is pulled away from corner bracket 95, the various segments 235, 236, and 237 telescope to an extended position wherein privacy screen assembly 10 can extend at least partially across a torso of an individual supported upon wheeled transport device 1. In the most preferred form of the invention as depicted, a pair of privacy screen assemblies 10 are provided on opposing sides of wheeled transport device 1. In addition, each end cap 240 includes a fastening device 242 for interconnecting the cross members 90 of the pair of privacy screen assemblies 10. In this manner, the interconnected cross members 90 will extend entirely across seat 23 and back 25 and, corresponding the entire chest zone of a nursing mother sitting on seat 23. In the most preferred forms of the invention, each fastening device 242 is defined by VELCRO or a magnetic connector. However, other equivalent connectors, including mechanical connectors, could equally be employed.

As indicated above, each privacy partition assembly 10 also includes a screen 100, with screen 100 being hung from cross member 90 for providing privacy to a nursing mother. As best shown in FIGS. 1 and 4, screen 100 is formed of a flexible and breathable fabric and is attached to cross member 90 through fasteners 250, such as metal or fabric loops. In this manner, screen 100 can be readily pulled across cross member 90 to provide the privacy desired.

Figure 2:
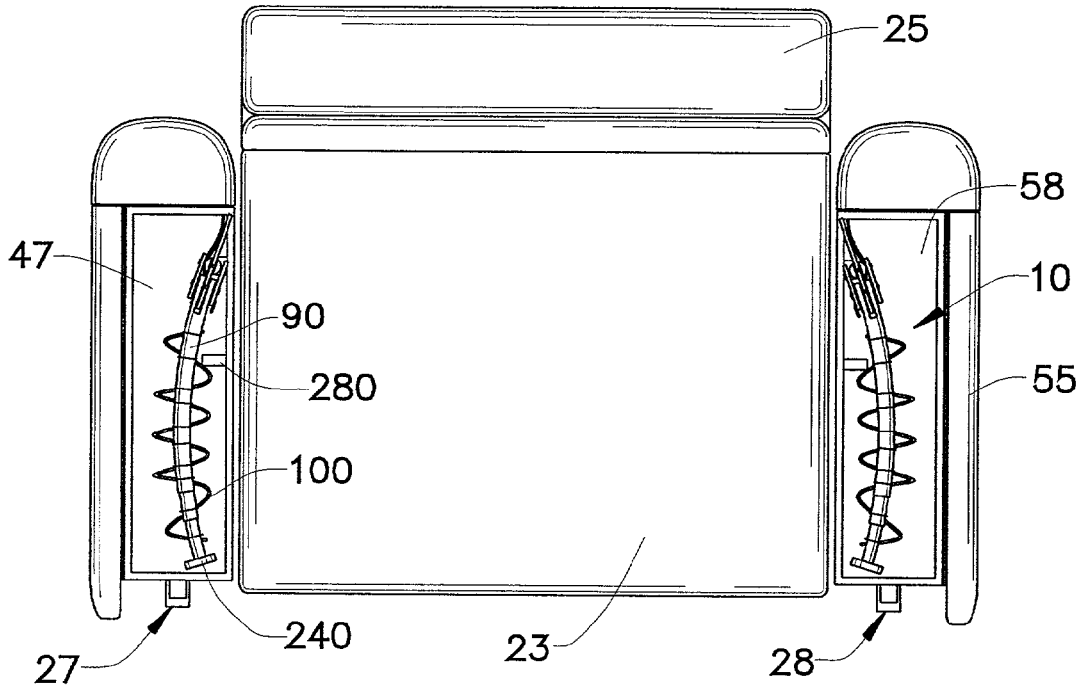
FIG. 2 is a top view of the wheeled transport device of FIG. 1, with the privacy partition assembly in a partially retracted position.
Figure 5:
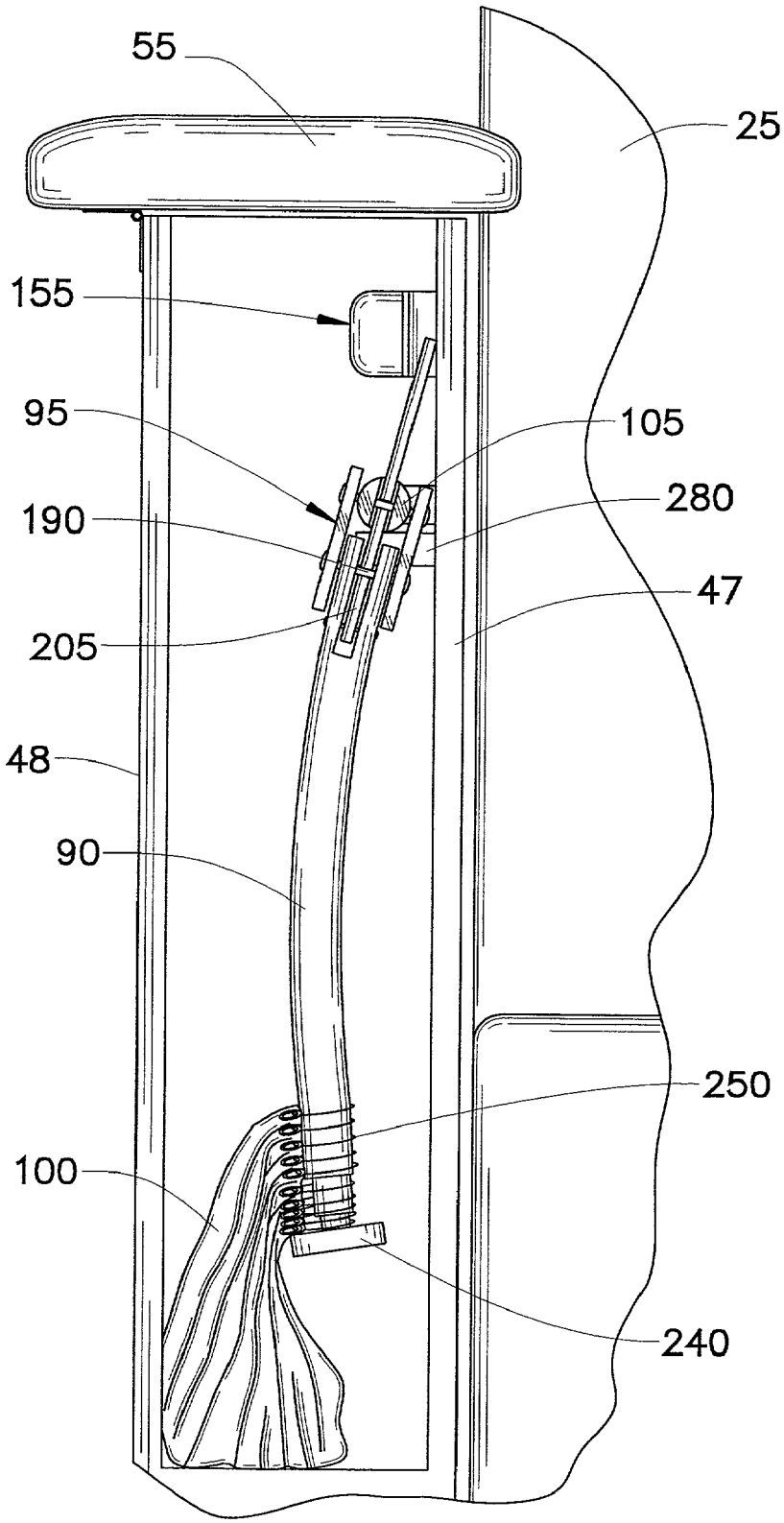
FIG. 5 is a front view of the privacy partition assembly in a retracted position.

In operation, privacy partition assembly 10 is movable between a storage position, as shown in FIGS. 2 and 5, and an in-use position, as shown in FIGS. 1 and 4. In order to begin using privacy partition assembly 10, an armrest 55 is initially pivoted to an open position to expose a respective storage compartment 57, 58. Next, the extension pole 85 of each assembly 10 is pivoted from the storage position of FIG. 5, wherein extension pole 85 abuts a pivot limiting or stop pin 280 within the storage compartment 57, 58, to engage extension pole 85 within a respective detent 175, 176 of catch member 155. Thereafter, cross member 90 is pivoted relative to extension pole 85 so that privacy partition assembly 10 assumes the position shown in FIG. 2 wherein lever 200 assumes the engagement position of FIG. 8. At this point it is possible to shift rod portion 105 relative to tube portion 110 in order to raise cross member 90 to a height appropriate to the nursing mother. Due to the ratcheting arrangement provided, rod portion 105 can be pulled out of tube portion 110 to a requisite height for the nursing mother whereupon pawl member 145 maintains extension pole 85 in its extended position. However, this function can also be performed later as well. Next, cross member 90 and rod portion 105 are rotated relative to and about an axis defined by tube portion 110 as represented in FIG. 3.

Figure 3:
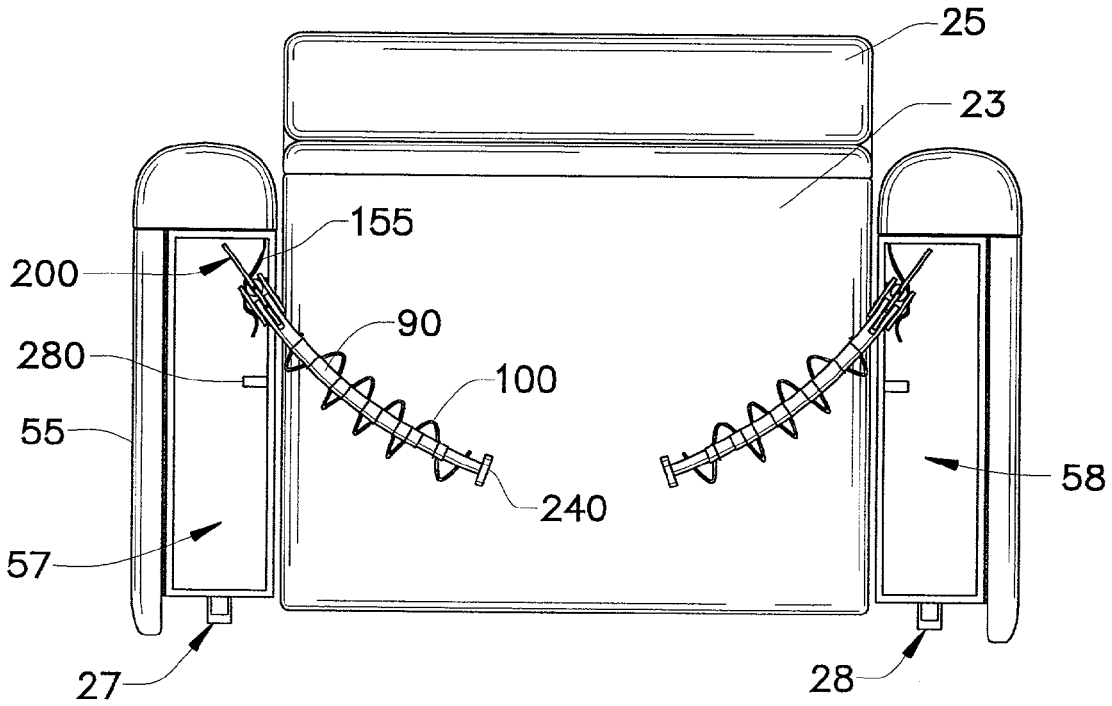
FIG. 3 is a top view of the wheeled transport device of FIG. 1, wherein the privacy partition assembly is in a partially deployed position.

The end cap 240 of cross member 90 is then pulled away from corner bracket 95 as cross member 90 is shifted away from extension pole 85 as shown in FIGS. 3 and 4. When employed with spaced privacy screen assemblies 10, the respective cross members 90 are extended and the end caps 240 are interconnected (see FIG. 1). Again, this function can be performed in a number of ways, such as through the use of VELCRO or a magnetic connection. Preferably, each cross member 90 takes an arcuate form so as to curve about the upper body of a nursing mother. With this overall arrangement, the curved nature of cross member(s) 90, the vertical adjustability of rod portion 105 and cross member 90 relative to tube portion 110, the extensibility of cross member(s) 90, and the ability to maintain extension pole 85 in a plurality of positions through catch member 155 enables privacy screen assembly 10 to be customized for the particular occupant. Finally, each screen 100 can then be extended to provide the proper level of privacy to a nursing mother sitting in seat 23.

In a generally reverse manner, privacy screen assembly 10 can be shifted to a stored or stowed position with the retraction of cross member 90, the releasing of lever 200 to cause pivoting of cross member 90 to adjacent extension pole 85, the lowering of extension pole 85 through pawl member 145, and the pivoting of extension pole 85 into a respective storage compartment 57, 58 about an axis defined by a shank portion of mechanical fastener 130. The amount that extension pole 85 can pivot is preferably limited by the presence of stop pin 280. Since cross member 90 is not positively maintained against extension pole 85, cross member 90 is permitted to drop into storage compartment 57, 58 as shown in FIG. 5. Of course, it is envisioned that other structure could be utilized to prevent cross member 90 from shifting relative to extension pole 85 if desired, particularly if a more compact arrangement is needed.

Figure 10:
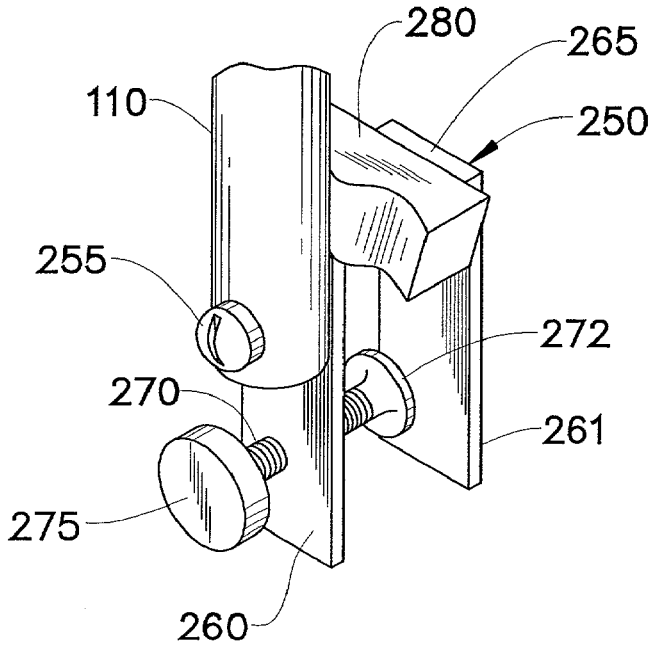
FIG. 10 is a perspective view of a bracket unit used in accordance with a second embodiment of the invention.

Although described with reference to a preferred embodiment of the invention, it should be readily apparent that various changes and/or modifications can be made to the invention without departing from the invention. For instance, it should be realized that privacy screen assembly 10 need not be used in pairs and can actually be applied to a wide range of wheeled transport devices, stationary chairs or beds, or even structure in a parked vehicle, i.e., privacy screen assembly 10 can be employed in combination with numerous occupant support structures. To this end, FIG. 10 illustrates an embodiment wherein tube portion 110 is pivotally attached to a bracket 250 through a fastener 255. As shown, bracket 250 generally takes the form of an inverted U-shaped member having legs 260 and 261, and a connecting member 265. A clamping screw 270, having a plate 272 on one end and a knob 275 on the other end, threadably extends through leg 260. In this manner, a frame or similar member of an occupant support (not shown) can be positioned between plate 272 and leg 261 and clamped therebetween to support privacy screen assembly 10. A detent block 280 is secured to connecting member 265 in order to accommodate the angling of extension pole 85 in a manner corresponding to that of the first described embodiment. In any event, although described with reference to preferred embodiments, it should be readily understood that various changes and/or modifications could be made to the invention without departing from the spirit thereof. Instead, the invention is only intended to be limited by the scope of the following claims.

I claim:

1. An occupant supporting device designed to provide privacy to a nursing mother who is breast feeding a baby by covering a torso portion of the nursing mother while enabling a head of the nursing mother to still be fully exposed comprising:

a frame;

a body support portion connected to the frame; and a privacy partition assembly for providing privacy to a nursing mother on the body support portion, said privacy partition assembly including:

a cross member mounted for movement relative to the frame between a stowed position, wherein the cross member is positioned adjacent to the frame, and an in-use position, wherein the cross member is adapted to extend directly across a torso portion of a nursing mother on the body support portion; and a screen connected to said cross member, wherein the screen is adapted to extend across the cross member in order to provide privacy to a nursing mother when the cross member is in the in-use position by extending directly across and covering only from a torso portion down, thereby shielding only a select portion of the nursing mother while still enabling a head of the nursing mother to be fully exposed above the screen.

2. The occupant supporting device according to claim 1, further comprising: a storage compartment connected to the frame, said privacy partition assembly being located in the storage compartment when in the stowed position.

3. The occupant supporting device according to claim 2, further comprising: an armrest pivotally mounted for movement between a first position, wherein the arm rest covers the storage compartment, and a second position, wherein the storage compartment is exposed.

4. The occupant supporting device according to claim 1, further comprising:

a second privacy partition assembly including:

a second cross member mounted for movement relative to the frame between a stowed position, wherein the second cross member is positioned adjacent to the frame, and an in-use position, wherein the second cross member is adapted to extend across a portion of a torso of a nursing mother; and a second screen connected to said second cross member, wherein the second screen is adapted to provide privacy to a nursing mother when the second cross member is in the in-use position.

5. The occupant supporting device according to claim 4, wherein each of the first and second cross members includes first and second ends, with said second ends being removably attached to each other when the first and second cross members are in the in-use positions.

6. The occupant supporting device according to claim 5, wherein the first end of each of the first and second cross members is mounted for pivotal movement relative to the frame between the stowed and in-use positions.

7. The occupant supporting device according to claim 1, further comprising: an IV pole attached to the frame.

8. The occupant supporting device according to claim 1, wherein the cross member is formed of multiple, telescoping segments.

9. The occupant supporting device according to claim 8, wherein the telescoping segments are arcuate.

10. The occupant supporting device according to claim 1, wherein the privacy partition assembly further comprises: an extension pole including a tube portion and a rod portion, with said tube and rod portions being slidably interconnected, said cross member being attached to the extension pole.

11. The occupant supporting device according to claim 10, wherein the extension pole is pivotally mounted relative to the frame.

12. The occupant supporting device according to claim 11, further comprising: means for retaining the extension pole in a selected one of a plurality of positions relative to the frame.

13. The occupant supporting device according to claim 10, wherein the cross member is pivotally attached to the extension pole.

14. The occupant supporting device according to claim 13, further comprising: a latch for releasably securing the cross member to the extension pole in the in-use position.

15. A privacy partition assembly for providing privacy to a nursing mother comprising:

a cross member formed of multiple, telescoping segments, said cross member being adapted to be mounted for movement relative to a frame between a stowed position, wherein the cross member is arranged in a low position adjacent to the frame, and an in-use position, wherein the cross member extends across a torso portion of a nursing mother; and a screen connected to said cross member, wherein the screen is adapted to provide privacy to a nursing mother only from a torso portion down, thereby shielding only a select portion of a nursing mother while still enabling a head of a nursing mother to be fully exposed above the screen when the cross member is in the in-use position.

16. The privacy partition assembly according to claim 15, wherein the telescoping segments are arcuate.

17. The privacy partition assembly according to claim 15, further comprising: an extension pole including a tube portion and a rod portion, with said tube and rod portions being slidably interconnected, said cross member being attached to the extension pole.

18. The privacy partition assembly according to claim 17, further comprising: means for retaining the extension pole in a selected one of a plurality of pivoted positions.

19. The privacy partition assembly according to claim 18, further comprising: means for retaining the extension pole in a selected one of a plurality of pivoted positions.

20. The privacy partition assembly according to claim 17, wherein the cross member is pivotally attached to the extension pole.

21. The privacy partition assembly according to claim 20, further comprising: a latch for releasably securing the cross member to the extension pole in the in-use position.

22. An occupant supporting device designed to provide privacy to a breast feeding mother while still enabling a head of the mother to be fully exposed comprising:

a frame;

a body support portion connected to the frame; and privacy partition means for providing a mother privacy while breast feeding a baby on the body support portion, said privacy partition means including:

cross support means mounted relative to the frame between a stowed position, wherein the cross support means is positioned adjacent to the frame, and an in-use position, wherein the cross support means extends directly across a torso portion of a nursing mother on the body support portion; and screening means, attached to the cross support means, provided for directly covering only a torso portion down of the nursing mother and shielding a breast of the nursing mother for privacy purposes while a head of the nursing mother will be fully exposed to enable her to conduct a face-to-face discussion with visitors and medical personnel when the cross support means is in the in-use position.

23. The occupant supporting device according to claim 22, wherein the occupant supporting device constitutes a wheelchair and the body support portion constitutes a seat of the wheelchair.

24. The occupant supporting device according to claim 23, further comprising: a storage compartment connected to the frame, said privacy partition assembly being located in the storage compartment when in the stowed position.

25. The occupant supporting device according to claim 24, further comprising: an armrest pivotally mounted for movement between a first position, wherein the arm rest covers the storage compartment, and a second position, wherein the storage compartment is exposed.

26. The occupant supporting device according to claim 1, wherein the occupant supporting device constitutes a wheelchair and the body support portion constitutes a seat of the wheelchair.

* * * * *